US006059208A

United States Patent [19]

Struthers

[11] Patent Number: 6,059,208

[45] Date of Patent: May 9, 2000

[54] BURIED PLASTIC SEWAGE SUMP

[75] Inventor: Kevin D. Struthers, Coatesville, Pa.

[73] Assignee: Interon Corporation, Exton, Pa.

[21] Appl. No.: 09/150,568

[22] Filed: Sep. 10, 1998

Related U.S. Application Data

[60] Provisional application No. 60/058,613, Sep. 11, 1997.

[51] Int. Cl.[7] ..... B02C 18/40

[52] U.S. Cl. ..... 241/46.01; 241/46.02; 241/285.1

[58] Field of Search ..... 241/46.01, 46.017, 241/46.02, 46.06, 46.11, DIG. 38, 285.1

[56] References Cited

U.S. PATENT DOCUMENTS

| | | | |
|---|---|---|---|
| Re. 28,104 | 8/1974 | Grace | 241/36 |
| 2,267,459 | 12/1941 | Hait | 103/119 |
| 2,512,764 | 6/1950 | Byram | 103/118 |
| 3,112,760 | 12/1963 | Budd | 137/363 |
| 3,390,224 | 6/1968 | Wyatt | 174/37 |
| 3,390,225 | 6/1968 | Couch et al. | 174/37 |
| 3,461,803 | 8/1969 | Stothoff, III et al. | 103/25 |
| 3,664,775 | 5/1972 | Stigberg | 417/566 |
| 3,667,692 | 6/1972 | Grace | 241/36 |
| 3,733,449 | 5/1973 | Parker | 200/81 R |
| 3,857,517 | 12/1974 | Grace et al. | 241/36 |
| 3,858,813 | 1/1975 | Hiller | 241/46.02 |
| 3,904,131 | 9/1975 | Farrell, Jr. et al. | 241/46.02 |
| 3,938,744 | 2/1976 | Allen | 241/46.11 |
| 3,999,890 | 12/1976 | Niedermeyer | 417/17 |
| 4,014,475 | 3/1977 | Grace et al. | 241/36 |
| 4,255,909 | 3/1981 | Söderström | 52/20 |
| 4,339,231 | 7/1982 | Conery et al. | 417/40 |
| 4,345,996 | 8/1982 | Lindman et al. | 210/96.1 |
| 4,709,723 | 12/1987 | Sidaway et al. | 137/584 |
| 4,793,387 | 12/1988 | LeBlanc et al. | 141/86 |
| 4,822,213 | 4/1989 | Grace et al. | 405/303 |
| 4,867,871 | 9/1989 | Bowne | 210/97 |
| 4,919,343 | 4/1990 | Van Luik, Jr. et al. | 241/36 |
| 5,038,817 | 8/1991 | Henry et al. | 137/315 |
| 5,046,886 | 9/1991 | Muir et al. | 404/25 |
| 5,095,667 | 3/1992 | Ryan et al. | 52/20 |
| 5,439,180 | 8/1995 | Baughman et al. | 241/36 |
| 5,553,794 | 9/1996 | Oliver et al. | 241/36 |
| 5,562,254 | 10/1996 | Sleasman et al. | 241/46.01 |
| 5,816,510 | 10/1998 | Earle, III et al. | 241/46.01 |

*Primary Examiner*—John M Husar

*Attorney, Agent, or Firm*—Seidel, Gonda, Lavorgna & Monaco, PC

[57] ABSTRACT

An integrally molded plastic sump basin formed with two distinct portions including a constant depth, shallow dry well at the top defining a controls area that is isolated from a varying depth wet well below, said wet well defining a pump chamber. All electronic controls, level sensor controls and valve extension control are situated in the non-hazardous dry well while pump(s) and associated piping are contained within the potentially hazardous wet well part of the basin. The sump basin may be formed with a drop inlet opening for sewage entry that enhances installation flexibility and provides more efficient processing of sewage entering the basin.

19 Claims, 5 Drawing Sheets

BURIED PLASTIC SEWAGE SUMP

This application claims priority from provisional application Ser. No. 60/058,613 filed Sep. 11, 1997.

FIELD OF THE INVENTION

This invention relates to an underground sump basin and more particularly a sewage sump basin where sewage enters the basin from a home or facility, is ground up by a sewage grinder pump to a fine slurry, and then pumped under low pressure to a waste treatment facility or a gravity collection system elsewhere.

BACKGROUND OF THE INVENTION

The concept of a wet well/dry well combination in a common structure is not novel. Dry wells are usually large areas that permit the entrance of a person to work on the components of a pumping system. Dry wells can be located at a fixed distance from the bottom of the sump where a pump is suspended through the floor of the dry well into the wet well below, hanging a given distance off of the bottom of the wet well. A deeper dry well is created as the depth of the basin increases due to such factors as the depth of the frostline. With today's 'confined space' work safety requirements and concerns with toxic fumes, the need to prevent unnecessary confined space entry and exposure to potentially hazardous environments is a major area of public interest and potential legal liability. It is well known that persons have been overcome by toxic fumes working in wet well environments, some with fatal consequences.

A typical basin for this sewage application is made from fiberglass or polyethylene and is simply a wet well, with electrical junction boxes located inside the basin and a control panel located on the outside surface. Most pumping stations use mechanical floats as fluid level controls, which have a tendency to malfunction either because they become fouled with grease, wedged stuck or tangled with other equipment. The floats require regular maintenance.

One prior embodiment of a residential sewage pumping system uses a wet well/dry well basin design. In this embodiment, the pump is bolted through a center shelf located at a fixed distance from the bottom so that the pump is suspended off the bottom. In order to accommodate different requirements for burial depth, extensions are added, increasing the depth of the dry well. A person servicing this type of system may be required to work inside the dry well to unbolt the pump and lift it up. As soon as the pump is removed, the dry well technically becomes part of the wet well, as there is nothing separating the two chambers. This becomes more of a problem when a person must reposition the pump onto the center shelf and bolt it back into place. Another problem with this particular system is the inability to physically watch the pump and level controller functioning.

Another potential problem with buried sewage sumps is the typically rigid piping-to-sump connection, which can be exposed to some large shear stresses as the basin shifts in the ground due to back filling, basin settling and/or hydrostatic lifting forces.

Many pumping system basins use a guide rail system for positioning the pump and holding it in place. The guide rails are typically bolted through the wall of the basin, which can act as a weak point for failure of the basin wall or for the development of future leaks.

SUMMARY OF THE INVENTION

The present invention provides the benefit of a shallow dry well integrally molded with a sewage grinder basin and wet well. The dry well is typically no deeper than about eight inches measured from the top of the sewage sump basin, though its depth may vary to accommodate control devices and electronics. A second lid over an aperture in the floor of the dry well isolates the potentially hazardous environment of the wet well from the shallow dry well. All of the electrical and sensor connections are made in the shallow dry well where they can be serviced without exposure to whatever effluent there might be in the wet well.

In a preferred embodiment of the invention, the plastic sewage sump basin employs ultrasonic level sensing, which is accomplished by a sensor mounted through the bottom of the dry well. This non-contact method of level sensing further prevents exposure to the contents of the sewage sump, which tend to grease, clog and foul other level sensing devices such as floats and pressure switches.

A ball valve that closes the outlet pipe is also operated from within the dry well portion of the sump basin. The only occasion to lift the inner lid in the dry well, creating exposure to the effluent, is to permit removal of the pump. The pump in the sump basin of the present invention is suspended off the bottom, held in a 'C' channel guide rail, and fitted with a 'quick disconnect' fitting. A plastic coated, stainless steel cable used to lift the pump is positioned at the top of the C-channel rail directly under the inner lid of the dry well.

The invention also features the use of an integrally molded-in reverse boss for the purpose of protecting external discharge piping connections from vertical shear forces. The piping joint made in the boss is protected from the shear forces of the ground by the vertical walls of the basin as it is back filled, where there may be position shifts of the pipe or the sump due to settling or the hydrostatic forces of a high water table.

One embodiment of the present invention further features the use of a basin with an integrally molded-in cup into which the C-channel rail is anchored without having to use bolt penetrations through the basin wall or floor. An alternative embodiment features a molded reverse boss in the bottom of the basin which creates a raised shape on the inside of the wet well. The bottom of the C-channel rail fits over the raised shape for the purpose of seating the C-channel rail on the bottom of the wet well without having to use bolt penetrations through the basin floor.

The present invention comprises a sewage grinder pump basin assembly comprising a molded plastic sewage sump, said sump being an integrally molded basin having a dry well area and a wet well area below the dry well and separated from it by a floor in the dry well, said floor having an opening over which a lid is removably seated, a grinder pump located in the wet well area for grinding sewage and pumping it out through a discharge pipe, and a lid removably attached to the sump covering the dry well area. The dry well area contains equipment comprising an electrical junction and control box, a remote shut-off handle for a valve controlling sewage output from the basin, and a level sensor. The dry well area has a shallow depth limited to that depth necessary to house the equipment. The opening in the dry well floor providing access to the wet well area below.

The wet well area contains a C-channel rail extending downwards from the dry well floor to the bottom of the wet well, a plumbing tree connected at a first end to the grinder pump and at a second end to a quick-disconnect fitting located in the C-channel rail, said grinder pump being located near the bottom of the wet well area.

The molded plastic sump further comprises a drop inlet molded into the wet well area of the sump as an outward projection of a side wall of the wet well, said drop inlet comprising a substantially horizontal outward projection from a side wall of the sump, said horizontal projection having an inlet opening provided for sewage inlet from above, said drop inlet further comprising a curved bottom wall for directing inlet sewage dropped through the inlet opening directly to the grinder pump in the bottom of the wet well, said molded drop inlet being connectable from directions varying over 180° with respect to the drop inlet opening.

The sump comprises a reverse boss molded into the side wall to provide a location for a pipe joint where the discharge pipe joins the sewage sump that is protected from direct underground stress caused by shifting of the sump or the surrounding soil.

BRIEF DESCRIPTION OF THE DRAWINGS

For the purpose of illustrating the invention, there are shown in the drawings forms which are presently preferred; it being understood however, that this invention is not limited to the precise arrangements and instrumentalities shown.

DESCRIPTION OF THE INVENTION

Figure 1:
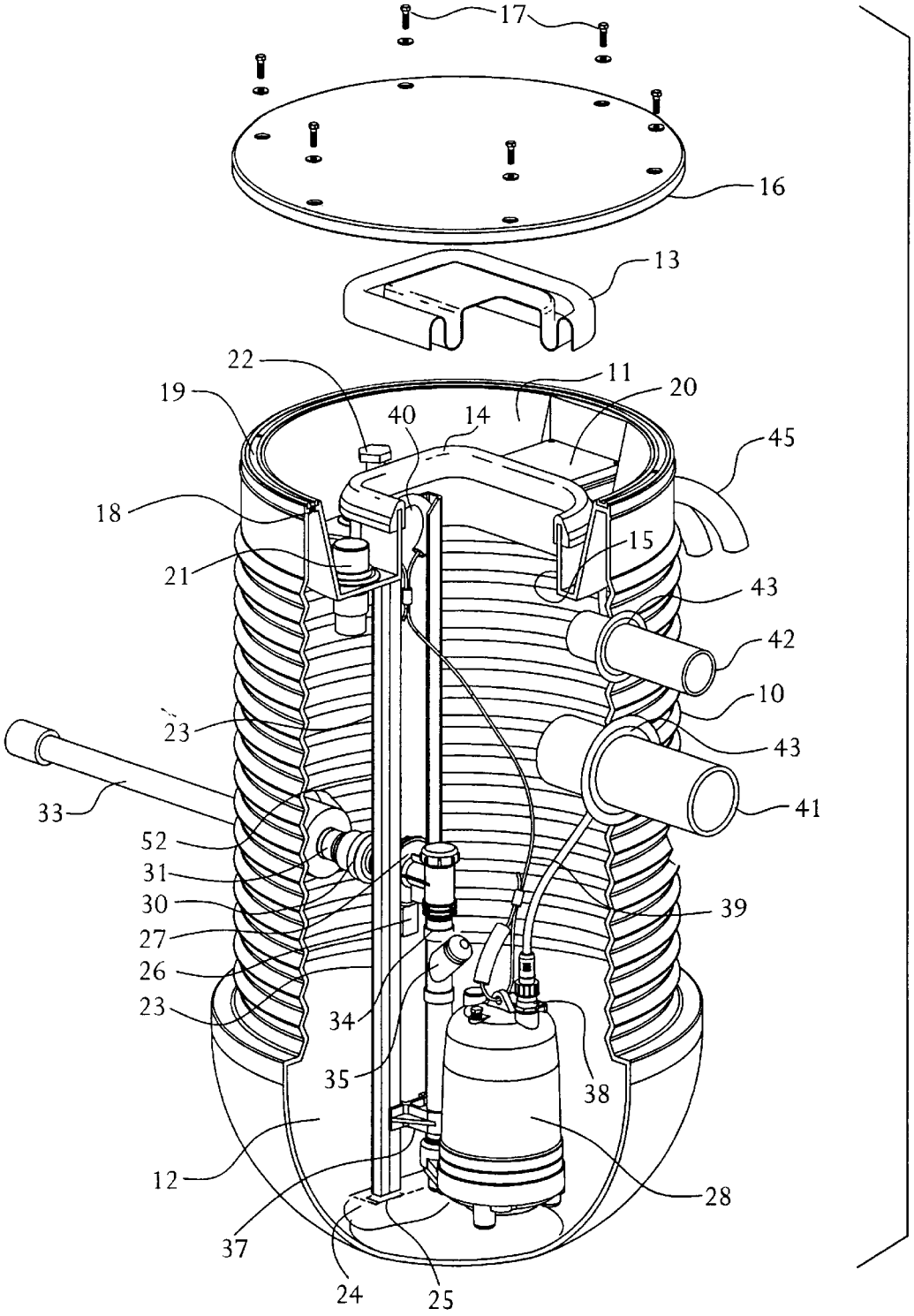
FIG. 1 is a cut-away perspective view of the sewage basin along with all the components of the complete system.

Referring to FIG. 1, a molded plastic basin 10 comprising an upper dry well area 11 and lower wet well area 12 is illustrated. The upper dry well area 11 is isolated from the lower wet well 12 by a floor 9 (FIG. 2) having an opening over which a molded plastic lid 13 is sealed with a rubber gasket 14. The gasket 14 is adhered to a raised lip 15. A molded nylon lid 16 is fastened to the basin 10 by means of stainless steel bolts 17 which screw into molded-in T-nuts 18 at the top of the basin 10. A rubber gasket 19 is fitted into a shallow channel along the top edge of the basin 10 to make a water-tight seal. Inside the dry well 11 is an electrical junction box 20, an ultrasonic level sensor 21 and a remote handle 22 for control of a shut off valve.

The dry well 11 need only be deep enough to house the equipment located within it. In the presently preferred embodiment of the sump, the dry well can be about eight inches deep and easily contain the junction box, level sensor element, and shut-off valve handle. A significant feature of the dry well is that it is shallow; it is only deep enough to house the necessary equipment elements in a dry well isolated from the wet well. The dry well cannot be entered or occupied by a service technician, nor need it be. The dry well 11 is accessed by removing the lid 16 from the basin and reaching arms and hands into the dry well to service the equipment, not by physically entering the dry well space.

The electrical junction box 20 houses both the electrical connections for the equipment in the sump basin 10 and the controls for operating the equipment. Among the latter are status indicator lights for the power, the grinder pump and level sensor, a manual override control, circuit breakers, and data connections. Because the junction box 20 is housed inside the basin rather than outside, the electrical connections, service connections and status indicators are all protected from the elements and easily accessed from above for service. It is possible, however, to locate the equipment controls, data connections and indicator lights in a separate enclosure within the dry well, isolating them from the power connections.

It is important in equipment that will be buried in the ground to protect any and all metallic hardware from exposure to the corrosive effects of the underground environment, particularly ground water and earth minerals. That is why all of the equipment for operating and servicing the grinder pump basin is contained within the basin. None remains outside; even the electrical power connections are made inside the basin.

In a preferred embodiment of the invention, the level sensor employed is an ultrasonic device that detects the level of effluent in the basin by bouncing sound waves off the surface of the effluent. This non-contact method of level sensing has advantages over mechanical means, which can stick, become fouled with grease and sludge, or deteriorate in contact with sewage. Other forms of non-contact sensors may also be employed within the scope of the invention. These may include infrared, laser or other photonic distance measuring devices, electro-optical and sonic distance detectors.

A water-tight lid 16 bolts down onto the top of the basin 10 with a rubber gasket 19 between basin 10 and lid 16. The T-nuts 18 that engage the stainless steel bolts 17 are molded into the rim of the basin 10 when the basin is fabricated. The T-nuts are locked into the plastic of the rim during the molding process, sealed from weather, ground water and sewage.

A plastic C-channel guide rail 23 is bolted to the lip 15 of the dry well access way and extends down to the bottom of the wet well 12 into an integrally molded-in cup 24. The bottom of the C-channel rail 23 is fitted with a rubber boot 25 to create a tight friction fit for the C-channel rail 23 into the cup 24 and prevent wear on the molded-in plastic cup 24. A stop 26 is mounted into the C-channel rail 23 which acts to position a quick-disconnect fitting 27 in line with the discharge piping 33 and to suspend the pump 28 above the bottom of the basin 10. The dimension of the quick disconnect fitting 27 is selected with sufficient tolerance to be located in the C-channel rail 23 and fit between a rubber seal in the quick disconnect fitting 27 and the corresponding flanged face of the discharge fitting 29. (See FIG. 2.)

Figure 2:
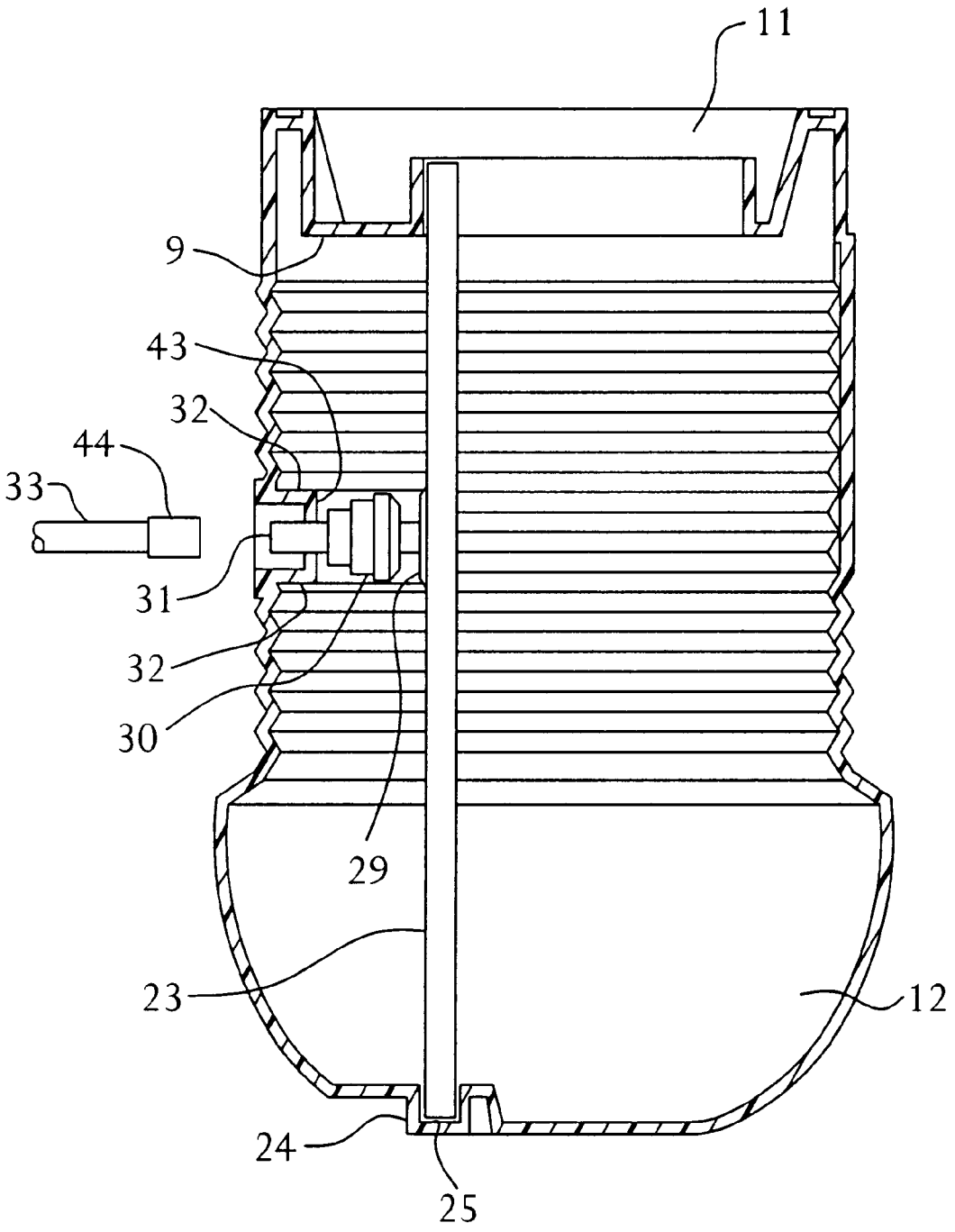
FIG. 2 is a vertical cross section of the basin showing the pertinent components of the sewage basin.

The flanged discharge fitting 29 is threaded through the C-channel rail 23 and secured in place with a lock nut (not shown). The flanged discharge fitting 29 is joined by a shaft 52 to a close-off ball valve fitting 30 which has a remote handle 22 located in the dry well 11 where the valve can be opened and closed without entering the wet well 12. The ball valve is fitted with a short pipe stub 31 that penetrates through the wall of the basin 10 at a reverse boss 32 (FIG. 2). The reverse boss 32 protects the connection of the flexible discharge pipe 33 to the pipe stub 31 from vertical shear forces of the ground.

The quick disconnect fitting 27 is attached to the pump 28 by means of a plumbing tree 34 which includes a check valve 35. The pump 28 is further held in position by a standoff fitting 37 designed to be captured in the arms of the C-channel rail 23. The pump 28 is wired with a quick disconnect plug 38 to make pump change-out a safe and fast operation. The pump 28, the quick disconnect fitting 27 and the whole plumbing tree 34 may be pulled out as one piece by means of a plastic-coated stainless steel cable 39 which is fitted with a plastic handle 40 made to friction fit into the top of the C-channel rail 23.

The penetrations through the basin 10 wall for the sewage inlet pipe 41, the vent pipe 42 and the discharge pipe 31 are all sealed with compression seal gaskets 43 that create a water tight seal while still allowing the respective pipes to deflect. The flexible pipe joint between the discharge pipe 33 and pipe stub 31 uses a PVC coupling swage (not shown) fitted to the flexible polyethylene pipe. These are full bore connections that do not inhibit the flow of effluent out of the tank. The PVC coupling can be glued to any solvent-weldable pipe being used for the collection piping system. This combination mechanical/glue connection can be used to join normally incompatible piping systems so that benefits of dissimilar systems can be combined for the best complete system.

Electrical conduit 45 is used to bring a power cable into the basin 10, deliver it to the dry well 11, and take a sensor cable (not shown) from the dry well 11 to a monitor located nearby (such as in a house or other facility served by the sump). The monitor allows a homeowner/facility manager to know if the sewage pump is operating normally, and indicates an alarm condition in the event of a problem.

FIG. 2 shows a cross section of a short standard basin 10 where the dry well 11 is separated from the wet well 12. This drawing also shows in detail the discharge piping connection, and in particular the reverse boss 32. The discharge pipe stub 31 attached to the ball valve 30 passes through the wall of the basin into the reverse boss 32. The discharge pipe stub 31 terminates within the depression of the boss 32 so that its connection to the plastic coupling 44 and discharge pipe 33 is made within the boss 32. The connection of the discharge pipe 33 to the plastic coupling 44 completes the discharge path out of the sewage sump. Also shown in FIG. 2 is the flanged discharge fitting 29 and the compression seal gasket 43. The integrally molded-in cup 24 is shown with the rubber boot 25 and the C-channel rail 23.

Figure 3:
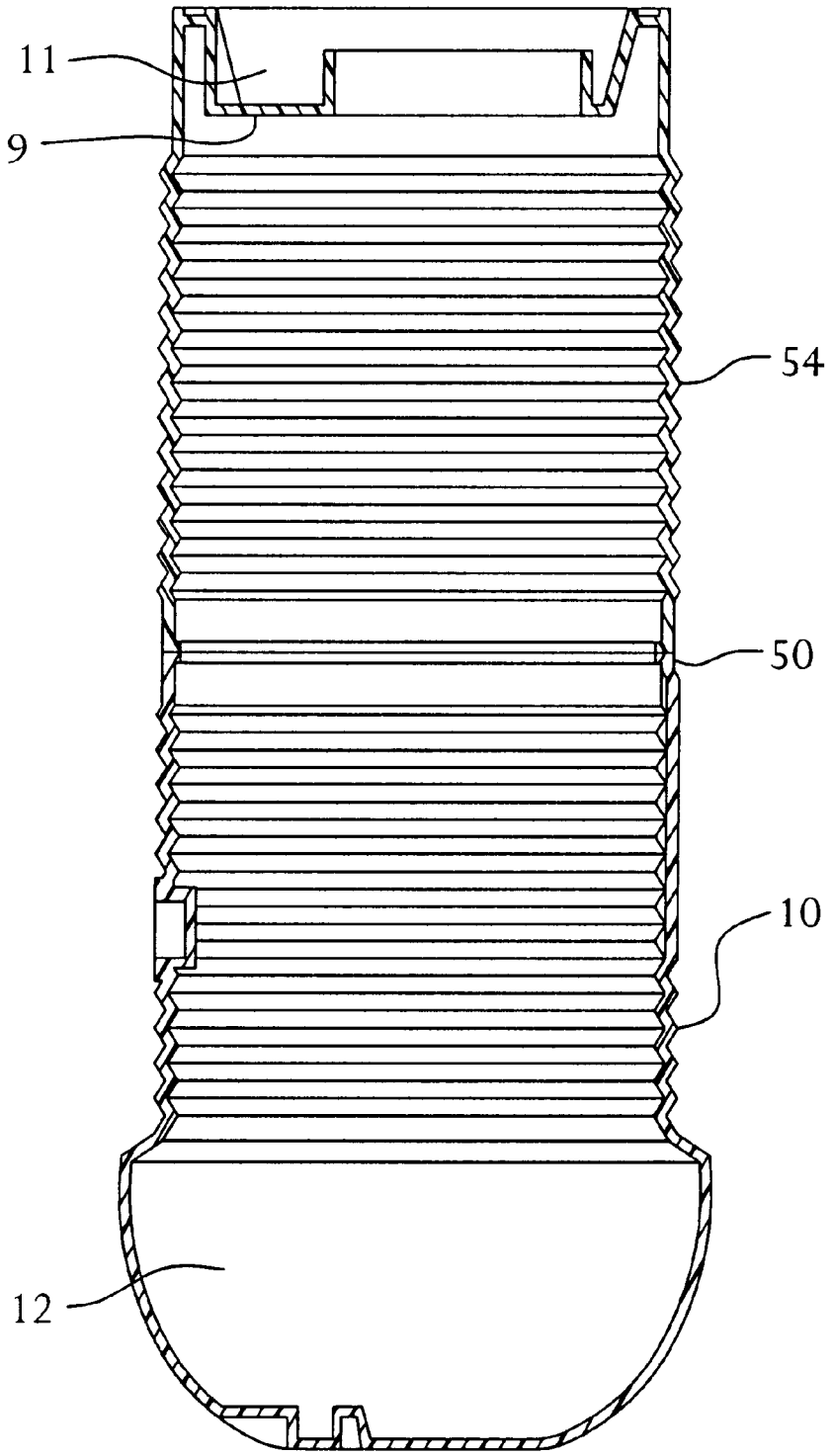
FIG. 3 is a vertical cross section of an extended basin showing how the dry well remains a fixed depth from the top in deeper basins.

FIG. 3 is a cross section of a basin 10 with a riser section 54 welded by a joint 50 to the standard base section to extend the depth of the basin as may be required in cold-weather areas with deeper frost lines. The dry well 11 remains located in the top of the riser 54 while the depth of the wet well 12 is extended upwards. The depth of the shallow dry well 11 remains the same.

In a presently preferred embodiment of the invention, the plastic basin 10 is molded of high density polyethylene (HDPE), which provides both structural strength and material compatibility with most sewage components such that the basin will not deteriorate by reacting with the contents. Other forms of plastic may be used where conditions dictate, depending upon the structural characteristic that may be most important in a given application.

Figure 4:
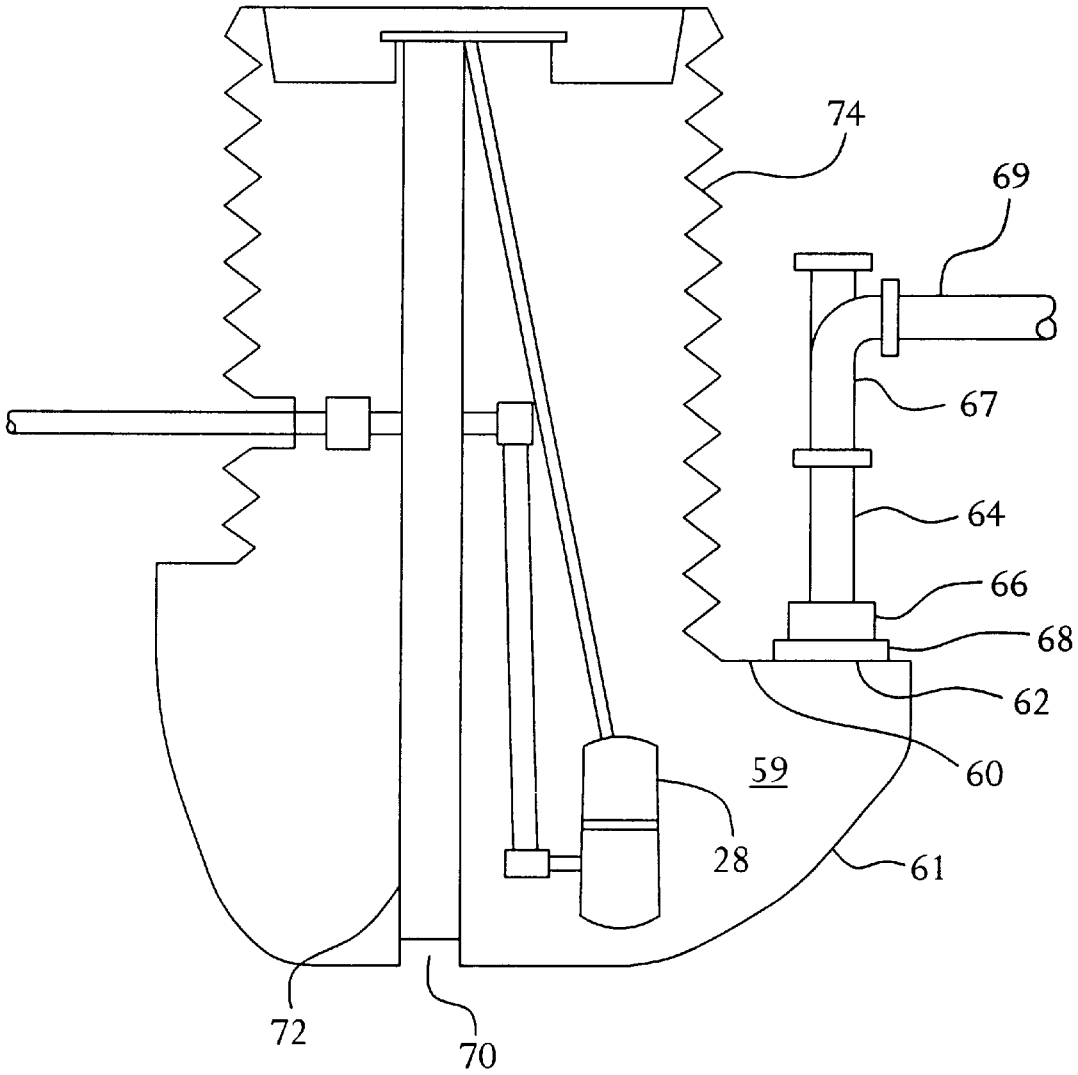
FIG. 4 is a vertical cross-section view of a second embodiment of the sewage basin.

Referring to FIG. 4, another embodiment of the sump, sewage enters the sump at a drop inlet 59 instead of directly through the side wall of the sump (as shown in FIG. 1). There is a functional advantage to having a drop inlet sewage entry. Sewage entering the sump is naturally directed toward the grinder pump 28 because of the sloped bottom 61 just beneath the drop inlet 59. The immediate channeling of sewage to the grinder pump helps ensure the quick and thorough grinding of sewage solids into a more homogenous slurry to be pumped out of the sump chamber.

In the drop inlet form of the sump, the basin 74 comprises a shelf 60 that extends away from the sidewall of the unit and affords a sufficiently large surface in which to place an inlet opening 62 that provides a portal for the entry of sewage into the basin 74 from the sewage inlet pipe 64. In order that the junction of the sewage inlet pipe 64 with the sump basin 74 is liquid-tight, a grommet 68 is fitted to the inlet opening 62 in the shelf 60. The grommet fits about a coupling 66 into which the inlet pipe 64 is inserted and sealed. Other instrumentalities than a grommet and coupling may be used to connect the inlet pipe 64 to the sump inlet opening 62 in a liquid-tight manner; the important thing is that the connection is not prone to leak, particularly if (when) the sewage slurry in the sump rises to a level in the basin that exceeds the height of the inlet 62 above the bottom of the basin.

A major benefit derived from the inclusion of the drop inlet sewage entry in a sump according to the invention is the latitude that the drop inlet affords for the angle of approach and entry of a sewage line into the sump. In the form illustrated in FIG. 1, having a simple straight through entry in the sump side wall, the sewage inlet pipe 41 must approach the sump basin 10 approximately perpendicular to the side wall. The installed sump basin must have its entry side turned toward the direction from which the inlet pipe approaches the sump. This may not be a problem in many installations and the side inlet sump will be the appropriate choice.

Figure 5:
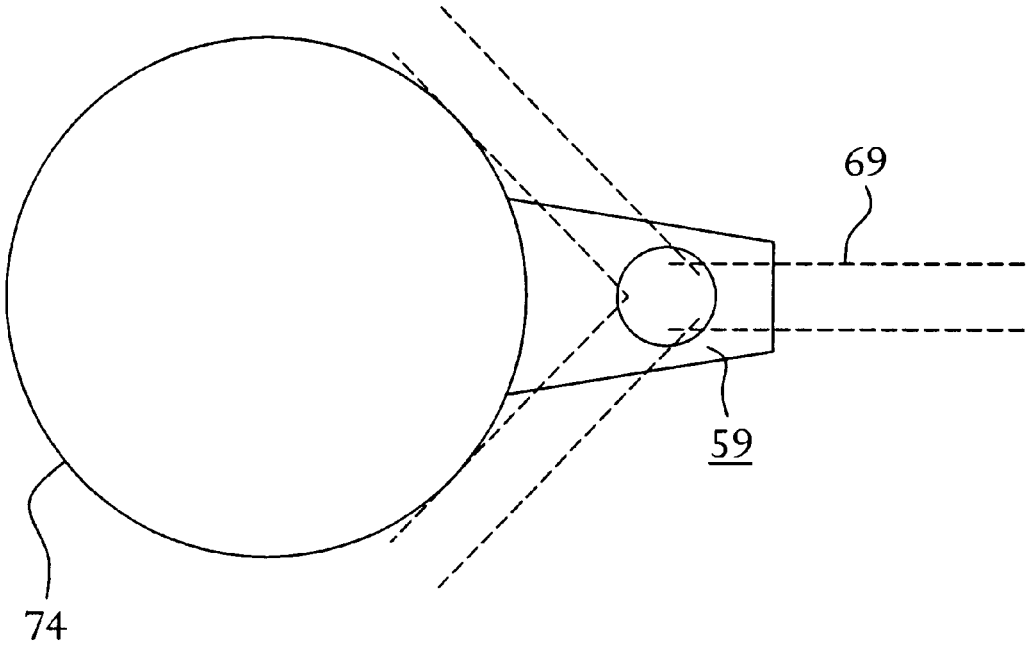
FIG. 5 is a top plan view of the embodiment illustrated in FIG. 4.

But the drop inlet form illustrated in FIG. 4 affords a range of direction up to between 180° to 270° from which the sewage supply pipe 69 may approach the sump basin 74. See FIG. 5, wherein the shadowed lines indicate the range of angles in which the sewage supply pipe 69 may approach the sump basin 10 and connect to the drop inlet 59. This enhances the flexibility available to the site planner when locating the sewage sump in relation to the building(s) to be served by it. This is particularly so where the sewage discharge pipe 33 is flexible and can be routed away from the sewage sump in nearly any direction.

Another degree of freedom and versatility provided by the drop inlet form of the sump is adjustment of the depth below ground that the sewage entry connection into the sump may be made. Referring again to FIG. 4, it can be seen that the length of the sewage inlet pipe 64 can be varied below the right angle joint 67, thereby changing the height of the connection between the sewage supply pipe 69 and the sewage inlet pipe 64.

In older sumps where the sewage supply pipe enters on the perpendicular directly into a fixed entry inlet in the side wall of the sump, in order to change the height of the entry point to accommodate the depth of the sewage supply pipe the entire sump had to be positioned higher or lower in the ground. Where the sewage pipe entry had to be particularly deep, a riser would have to be added to the sump basin to extend it up to near grade level; in other cases the sump height might have to be cut down. In the present invention, the drop inlet permits changing the height of the connection to the sewage supply pipe without changing the burial depth of the sump itself and without making height adjustments in the physical configuration of the sump basin.

The sewage basin of FIG. 4 also illustrates an alternative embodiment of the anchoring structure for the C-channel at the bottom of the wet well. A reverse boss may be molded into the bottom of the plastic basin 74, which creates a raised shape 70 on the inside of the basin. The shape may be circular, square or another common form. In a presently preferred form, the raised shape 70 is triangular. The raised shape 70 serves as an anchor point for the C-channel. The C-channel 72 fits over the raised shape 70, with one point on the raised triangle shape contacting the rear of the channel and the other two points contacting the front (open side) of the channel on either side of the opening in the "C". This connection provides a stable bottom anchor point for the C-channel rail without the use of penetration connectors such as screws, bolts and nuts, or rivets.

The present invention may be embodied in other specific forms without departing from the spirit or essential attributes thereof and, accordingly, reference should be made to the appended claims, rather than to the foregoing specification, as indicating the scope of the invention.

What is claimed is:

1. A sewage grinder pump basin assembly comprising:

a molded plastic sewage sump, said sump being an integrally molded basin having a dry well area and a wet well area below the dry well and separated from it by a floor in the dry well, said floor having an opening over which a lid is removably seated, a grinder pump located in the wet well area for grinding sewage and pumping it out through a discharge pipe, and a lid removably attached to the sump covering the dry well area, said molded plastic sump further comprising a drop inlet molded into the wet well area of the sump as an outward projection of a side wall of the wet well, said drop inlet comprising a substantially horizontal outward projection from a side wall of the sump, said horizontal projection having an inlet opening provided for sewage inlet from above, said drop inlet further comprising a bottom wall shaped for directing inlet sewage dropped through the inlet opening directly to the grinder pump in the bottom of the wet well, said molded drop inlet being connectible from directions ranging to over 180° with respect to the drop inlet opening.

2. The sewage grinder pump basin of claim 1, wherein the drop inlet provides variable height adjustment for connection of sewage inlet pipes carrying sewage to the basin.

3. The sewage sump of claim 1, further comprising:

a reverse boss in the basin wall in which a pipe connection may be made that is shielded from shear forces on the pipe.

4. A sewage grinder pump basin assembly comprising:

a molded plastic sewage sump, said sump being an integrally molded basin having a dry well area and a wet well area below the dry well and separated from it by a floor in the dry well, said floor having an opening over which a lid is removably seated, a grinder pump located in the wet well area for grinding sewage and pumping it out through a discharge pipe, and a lid removably attached to the sump covering the dry well area, said dry well area containing equipment comprising an electrical junction box, a remote shut-off control for a valve controlling sewage output from the basin, and a level sensor, said dry well area having a shallow depth limited to that depth necessary to house the equipment, the opening in the dry well floor providing access to the wet well area below;

said wet well area containing a C-channel rail extending downwards from the dry well floor to the bottom of the wet well, a plumbing tree connected at a first end to the grinder pump and at a second end to a quick-disconnect fitting located in the C-channel rail, said grinder pump being located near the bottom of the wet well area;

said molded plastic sump further comprising a drop inlet molded into the wet well area of the sump as an outward projection of a side wall of the wet well, said drop inlet comprising a substantially horizontal outward projection from a side wall of the sump, said horizontal projection having an inlet opening provided for sewage inlet from above, said drop inlet further comprising a bottom wall shaped for directing inlet sewage dropped through the inlet opening directly to the grinder pump in the bottom of the wet well, said molded drop inlet being connectible from directions ranging to over 180° with respect to the drop inlet opening.

5. The sewage sump of claim 4, wherein the electrical junction box houses controls and status indicators for the equipment in the wet well of the sump.

6. The sewage sump of claim 4, wherein the molded plastic sump comprises a reverse boss molded into the side wall to provide a location for a pipe joint where the discharge pipe joins the sewage sump that is protected from direct underground stress caused by shifting of the sump or the surrounding soil.

7. A sump for a sewage grinding pump, comprising:

a molded plastic basin including a drop inlet attached to a lower portion of the basin and projecting outward therefrom, said drop inlet comprising a substantially horizontal outward projection from a side wall of the basin, said horizontal projection having an inlet opening provided for inlet of sewage from above, said drop inlet further comprising a bottom wall shaped for directing inlet sewage dropped through the inlet opening directly to a grinding pump located adjacent the bottom of the basin, said molded drop inlet being connectible from directions ranging to over 180° with respect to the drop inlet opening.

8. The sump of claim 7 wherein the basin further comprises a dry well and a wet well below the dry well and separated from the dry well by a floor in the dry well, said floor having an opening over which a lid is removably seated, the lid being removable attached to the sump covering the dry well area.

9. The sump of claim 8 further comprising a grinder pump located in the wet well area for grinding sewage and pumping it out through a discharge pipe.

10. The sump of claim 9 wherein the wet well contains a C-channel rail extending downward from the dry well floor to the bottom of the wet well, a plumbing tree connected at a first end to the grinder pump and at a second end to a quick-disconnect fitting located in the C-channel rail, said grinder pump being located near the bottom of the wet well.

11. The sump of claim 8 wherein said dry well contains equipment comprising an electrical junction box, a remote shut-off control for a valve controlling sewage output from the basin and a level sensor.

12. The sump of claim 11 wherein said dry well has a shallow depth limited to that depth necessary to house the equipment, the opening in the dry well floor providing access to the wet well below.

13. The sump of claim 7 further comprising a reverse boss in the basin wall in which a pipe connection may be made that is shielded from shear forces on the pipe.

14. A sump for a sewage grinding pump, comprising:

a molded plastic basin having an outer wall that partially defines the interior of the basin; and a reverse boss for receiving a flexible pipe therethrough, the reverse boss having a side wall and an end wall, the side and end walls defining a depression projecting into the interior of the basin, the side wall attached at one end to the outer wall of the basin and at the opposite end to the end wall, the end wall having an aperture therethrough for receiving the pipe.

15. The sump of claim 14 wherein the reverse boss is molded integrally with the outer wall of the basin.

16. The sump of claim 14 further comprising a compression seal gasket located in the aperture between the end wall of the reverse boss and the wall of a pipe located therethrough.

17. The sump of claim 14 further comprising a discharge pipe stub that projects from inside the sump, through the end wall of the boss and terminates within the depression of the boss.

18. The sump of claim 17 further comprising a coupling sleeve located at least partially within the depression and sleevedly engaging the discharge pipe stub.

19. The sump of claim 18 further comprising a discharge pipe sleevedly engaged within the coupling sleeve and projecting outside the depression.

* * * * *